US010562681B2

(12) United States Patent
Koenigseder et al.

(10) Patent No.: US 10,562,681 B2
(45) Date of Patent: Feb. 18, 2020

(54) DISPENSING CLOSURE FOR A FLUID CONTAINER

(71) Applicants: APTAR FREYUNG GMBH, Freyung (DE); APTARGROUP, INC., Crystal Lake, IL (US)

(72) Inventors: Bruno Koenigseder, Roehrnbach (DE); Pranav Mahesh Bhatt, Mooresville, NC (US); Andreas Rueckert, Ringelai (DE); Stacy L. Beilke, Eagle, WI (US)

(73) Assignees: Aptar Freyung GmbH (DE); AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 16/306,084

(22) PCT Filed: Nov. 6, 2017

(86) PCT No.: PCT/EP2017/078354
§ 371 (c)(1),
(2) Date: Nov. 30, 2018

(87) PCT Pub. No.: WO2019/086132
PCT Pub. Date: May 9, 2019

(65) Prior Publication Data

US 2019/0135504 A1 May 9, 2019

(51) Int. Cl.
*B65D 47/08* (2006.01)
*B65D 55/02* (2006.01)
*B65D 55/08* (2006.01)

(52) U.S. Cl.
CPC ..... *B65D 47/0804* (2013.01); *B65D 47/08* (2013.01); *B65D 55/024* (2013.01); *B65D 55/0818* (2013.01); *B65D 2101/0053* (2013.01)

(58) Field of Classification Search
CPC .... B65D 47/0804; B65D 47/08; B65D 47/06; B65D 47/04; B65D 55/024; B65D 55/02; B65D 55/0818; B65D 55/08; B65D 55/06
See application file for complete search history.

(56) References Cited

U.S. PATENT DOCUMENTS 4,487,324 A * 12/1984 Ostrowsky ..... B65D 47/0814 215/225
5,096,077 A * 3/1992 Odet ..... B65D 47/0838 215/211

(Continued)

FOREIGN PATENT DOCUMENTS

EP 1 503 942 B1 5/2006
FR 2 267 253 A1 11/1975

OTHER PUBLICATIONS

International Search Report and Written Opinion, dated Jul. 3, 2018 in International Patent Application No. PCT/EP2017/078354.

*Primary Examiner* — Steven A. Reynolds
*Assistant Examiner* — Javier A Pagan
(74) *Attorney, Agent, or Firm* — Wood, Phillips, Katz, Clark & Mortimer

(57) ABSTRACT

The present invention relates to a dispensing closure comprising a base element, which can be attached to a neck of a container, a flip-top lid, being attached to said base element by a hinge and being movable between a closed and an opened position, and a tamper-evident element extending in a circumferential direction around at least part of the circumference of said dispensing closure, wherein the tamper-evident element has at least one weakening region extending at least over part of the height of the tamper-evident element and/or wherein a shoulder region of the base element, to which frangible elements of the tamper-evident element are (Continued)

attached, is inclined such that it declines in an outward direction of the base element.

15 Claims, 5 Drawing Sheets

(56) References Cited

U.S. PATENT DOCUMENTS

| | | | | |
|---|---|---|---|---|
| 5,547,091 | A * | 8/1996 | Neveras | B65D 35/14 215/237 |
| 6,766,926 | B1 * | 7/2004 | Elchert | B65D 47/0814 222/498 |
| 2005/0279727 | A1 * | 12/2005 | Graswald | B65D 47/0804 215/237 |
| 2007/0144996 | A1 * | 6/2007 | Sawyer | B65D 47/0809 215/235 |
| 2008/0314860 | A1 * | 12/2008 | Pugne | B65D 55/022 215/330 |
| 2009/0107948 | A1 * | 4/2009 | Brand | A61J 1/1406 215/247 |

* cited by examiner

DISPENSING CLOSURE FOR A FLUID CONTAINER

FIELD OF THE INVENTION

The present invention relates to a dispensing closure for a container with an opening and possibly with a spout for dispensing a fluid, while the dispensing closure comprises a flip-top lid, which can be moved between an opened position and a closed position.

BACKGROUND OF THE INVENTION

Typically such dispensing closures are designed such that the closures can be attached to a neck of a container, e.g. by screwing the dispensing closure onto the neck of a container, so that a fluid can be dispensed out of the container and through the opening or a spout of the dispensing closure.

Such dispensing closures are used for many different purposes and are frequently used for containers which contain fluid media, especially drinks or other method products, but such dispensing closures can be also used for containers storing other fluids or viscous products. Such a dispensing closure is for example disclosed in EP 1 503 942 B1.

BRIEF SUMMARY OF THE INVENTION

It is an object of the present invention to enhance such a closure as known in the prior art and especially in the above-mentioned document, especially with respect to its tamper-evident properties.

This problem is solved by a dispensing closure according to claim 1, claims 2 to 14 refer to specifically advantageous realizations of such a dispensing closure. The problems are also solved by a dispensing closure according to claim l5, especially in combination with the features disclosed in any of the claims 1 to 14.

According to the present invention, the dispensing closure comprises a base element which can be attached to a neck of a container and which comprises a dispensing opening, a flip-top lid, being attached to said base element by a hinge and being movable between a closed position, in which the dispensing opening is closed by a closing element of said flip-top lid, and an opened position, in which said dispensing opening is at least partly opened such that a fluid can be dispensed through said dispensing opening, a tamper-evident element extending in a circumferential direction around at least a part of the circumference of said dispensing closure and being attached to a shoulder region of said base element by at least two frangible elements having a pre-determined breaking point, said flip-top lid having at least one opening or recession being arranged and dimensioned such that it encloses at least part of at least one locking extension of the tamper-evident element extending, from said tamper-evident element or an element or part thereof, at least partly into the direction of the flip-top lid, when said flip-top lid is in its closed position and said tamper-evident element is in its original position with the frangible elements being undestroyed.

The direction into which the locking extension is at least partly extending, is, when viewing the closure in its upright position, a vertical direction. This vertical direction is normal to the circumferential direction. Typically these closures have a circular cross-section, so that the closures can be screwed onto a neck of a container, preferably by interrelated threads, typically an inner thread in the closure and an outer thread at the neck of a container.

According to the invention, said tamper-evident element has at least one weakening region, preferably in the vicinity of one of said at least one locking extension, said at least one weakening region extending at least partly over the height of the tamper-evident element, and/or said shoulder region of said base element, to which said frangible elements of said tamper-evident element are attached, is inclined such that it declines in an outward direction of the base element.

When the closure is in its upright position and when the tamper-evident element is in its original position, namely before opening of the closure for the first time, also the tamper-evident element is in its upright position so that the height of the tamper-evident element is extending in a vertical direction.

One advantage of the present invention is that the tamper-evident element of the inventive dispensing closure does, in a more obvious way show to the user, if and when the closure has been opened for the first time, especially by a more visual deformation of the tamper-evident element by itself and/or by a more visual deformation of the frangible elements and/or by a more visible shift of the position of the tamper-evident element in or at the dispensing closure, if the tamper-evident element should be still somehow located at the dispensing closure, e.g. also due to the fact that a user tries, on purpose, to re-position the tamper-evident element after a first opening of the closure.

This even more enhances the tamper-evident capabilities of the dispensing closure and makes it even more obvious to a user, whether the dispensing closure has been opened at least once, even if the dispensing closures should have been opened in a very careful way or even with the intention of a user to hide that the dispensing closure has been opened already at least once, e.g. by trying to re-position the tamper-evident element which has been detached from the closure by a first opening.

Especially the provision of a weakening region in the tamper-evident element, preferably in the vicinity of one of said at least one locking extensions extending at least partly over the height of the tamper-evident element, increases this advantageous effect, as especially in this region of the tamper-evident element a more visible deformation is created when a force is exerted onto the tamper-evident element when opening the dispensing closure for the first time.

A shoulder region of said base element, to which said frangible elements of said tamper-evident element are attached, being inclined such that it declines in an outward direction, especially a radially outward direction, of the base element also ensures that there is a remarkably higher likelihood that the position of a tamper-evident element after a first opening of the dispensing closure, therefore after a destruction of at least one or some or all of the frangible elements, will be visibly different from the original position of the tamper-evident element with the frangible elements being undestroyed, even if somebody should try to put the tamper-evident element on purpose hack into a position being close to such an original position, as the tamper-evident element will, due to the three of gravity, slide at least partly along the declined shoulder region. This is of specific advantage especially with dispensing closures having a tamper-evident element with a locking extension being enclosed at least partly by an opening or recession in a flip-top lid, while such an opening or recession in the flip-top lid and the corresponding locking extension also serves to avoid a manipulation of the dispensing closure and the tamper-evident element.

In summary therefore, the features of the dispensing closure according to claim 1 serve to provide a very secure tamper evident function and high quality properties, being even further enhanced over the already high security of existing closures.

According to a preferred embodiment one of said at least one weakening region comprises either a notch extending over a part of the height of the tamper-evident element or comprises a weakening line, reducing the thickness of the tamper-evident element over at least part of the height of the tamper-evident element. These two possibilities for providing a weakening region are specifically of advantage, as it is easy to manufacture a dispensing closure with such a weakening region, preferably by injection molding, furthermore the realization of such weakening regions also decreases the weight of the dispensing closure, which is major cost factor for these mass products.

By realizing the weakening region by any of these two preferred embodiments therefore both a reduction of costs and further increase of quality regarding the tamper-evident function is realized at the same time.

Preferably the notch extends over a major part of the height of the tamper-evident element, preferably the notch extends at least over 50% of the height of the tamper-evident element, more preferably over at least 70% and even more preferably over at least 80% of the height of the tamper-evident element. In one preferred embodiment, the notch is provided on an upper side of the tamper-evident element, i.e. on the side which is directed to the flip-top lid, when this lid is its closed position. However, alternatively, it is also possible to provide the notch at a lower side of the tamper-evident element, i.e. at the side being directed to the base element.

It is possible to provide only one notch, however, in another embodiment it is also possible to provide multiple notches.

The "height" of the tamper-evident element is typically measured in a vertical direction, being a direction normal to the circumference of the dispensing closure.

According to a specifically preferred embodiment a weakening line is provided on the inner side of the tamper-evident element, so that it is not visible to a user from the outside, when the dispensing closure is in its closed position and especially when it is not yet opened for the first time, while nevertheless the desired function, namely a deformation of the tamper-evident element is more easily created when opening the dispensing closure, i.e. when moving the flip top lid from its closed position to an opened position for the first time, which will lead to a tearing off of the tamper-evident element, e.g. by one or more hooks which interact with for example openings or projections of the tamper-evident element in a way that during opening of the flip-top lid a force is exerted onto the tamper-evident element which destroys the frangible elements.

In one preferred embodiment said tamper-evident element comprises two locking extensions, wherein said weakening region is provided, in a circumferential direction, between these two locking extensions. This realization further increases the susceptibility or sensitivity of the tamper-evident element to be deformed when the dispensing closure is opened for the first time. This effect is realized both when having a weakening region comprising a notch and/or when having a weakening region comprising a weakening line, as referred to above.

In this respect it shall be noted that a weakening region can be also realized by both a notch and a weakening line, namely with a notch extending over a part of the height of the tamper-evident element, while a weakening line extending over another part and preferably over the remaining part of the height of the tamper-evident element. In one embodiment, a notch and a weakening line are provided at the same angular or circumferential position, however, it is also possible to provide at least one notch and/or at least one weakening line at different angular or circumferential positions of the tamper-evident element.

In a specifically preferred embodiment a weakening region extends over the complete circumferential distance between two locking extensions. The larger the weakening region is, especially the more the weakening region extends in a circumferential direction, the more the above-mentioned effects, especially a deformation of the tamper-evident element is unavoidably created when the dispensing closure is opened for the first time, especially due to the force exerted onto the tamper-evident element by the opening and the thereby generated destruction of the frangible elements.

According to another preferred embodiment said tamper-evident element comprises one or even only one locking extension and at least two weakening regions, which, in a circumferential direction of the tamper-evident element, are positioned preferably directly adjacent said one locking extension. This embodiment has the advantage that a lower number of locking extensions and possibly only one single locking extension is necessary, which again has advantages during the manufacturing process and decreases the weight of the dispensing closure, while on the other hand the susceptibility for deformation of the tamper-evident element is increased, especially by the close interrelationship of the locking extension and the weakening regions positioned directly adjacent to said locking extension, increasing the susceptibility to deformations when a three is applied.

According to a preferred embodiment the dispensing closure has at least one frangible element in a circumferential position of said tamper-evident element where a weakening region is provided or in the vicinity of such a weakening region. This realization has the advantage that the force exerted onto the frangible element when opening the dispensing closure for the first time is directly transferred to the weakening region, also increasing the susceptibility to deformations.

Similarly, and preferably in addition to the above-mentioned preferred realization, a preferred dispensing closure has a frangible element also positioned at the circumferential borders of at least one locking extension or in the direct vicinity thereof, as also this realization supports a better transfer of the force exerted especially on the frangible element during opening of the dispensing closure, thereby increasing susceptibility to deformation of the tamper-evident element.

According to a preferred embodiment, the tamper-evident element of the dispensing closure comprises multiple weakening regions over the extension of the tamper-evident element in its circumferential direction. This realization has the advantage that the weakening effect of the weakening regions is provided at various parts of the circumference of the tamper-evident element, so that the susceptibility to deformation is increased at various parts of the tamper-evident element, so that a deformation is more likely even if the dispensing closure is opened for the first time by applying a force in different ways, depending on the activities of the user.

According to a preferred embodiment, the number of frangible elements is concentrated in a certain area over the extension of the tamper-evident element.

Especially the number of frangible elements per angular extension of the tamper-evident element in its circumferential dimension is higher in those circumferential angular regions, where a locking extension is provided, when compared to those angular circumferential regions where no locking extension of the tamper-evident element is provided.

This specific realization has the advantage that the force exerted on the tamper-evident element is concentrated on a specific part of the tamper-evident element, so that also by this measurement the susceptibility to deformation is further increased.

According to another specific realization of the dispensing closure according to the present invention, the shoulder region of said base element is declined in an outward direction, especially in a radially outward direction, of the dispensing closure, by an angle of 10° to 45' relative to a horizontal direction further preferably by an angle of 15' to 30 relative to the horizontal direction.

This embodiment has the advantage that the tamper-evident element tends to automatically shift its position relative to the original position, in which the frangible elements are undestroyed, after a first opening of dispensing closure, simply by gravitational forces when the closure and/or the container is in its upright position, even if, possibly on purpose, a user tries to place the tamper-evident element into about the same position as its original position after having opened the dispensing closure for the first time or when not having opened the lid completely.

These realizations therefore have a major effect on the tamper-evident capabilities, especially for devices which have the additional security feature of the locking extension of the tamper-evident element, which is partly covered by an opening or recession in the flip-top lid.

According to a preferred realization said shoulder region of said base element is declined over at least the complete circumferential extension of the tamper-evident element, as this further enhances the above-mentioned effect and as this secures that any part of the tamper-evident element, after having been detached from the base element by destruction of the frangible element, at best rests on the declined shoulder region, so that independent of the specific position of the tamper-evident element, if not already fully removed from the closure, the above-mentioned effect is automatically supported by the gravitational forces.

Further preferably all frangible elements are attached to said shoulder region of said base element in an area where the shoulder region is declined, which also supports the above-mentioned effect.

According to another, even independently inventive aspect of the present invention, a dispensing closure, especially but not necessarily also realizing the above-mentioned features, comprises a frangible element having an hour-glass shape, wherein preferably some or more preferably even all frangible elements have an hour-glass shape.

This specific shape leads to the effect that the forces applied to the frangible elements during a first opening of the dispensing closures lead to specifically well visible and obvious deformations both of the remaining parts of the frangible elements and/or the tamper-evident element, when opening the dispensing closure for the first time.

An hour-glass shape of the frangible elements also typically leads to the effects that after destruction the remaining parts of the frangible elements are more elongated than with otherwise shaped elements, which also leads to the effect that it is more difficult to keep the tamper-evident element in its original position after the frangible elements have been destroyed, even if a user should try this on purpose or should try to re-position the tamper-evident element.

This effect is of course even enhanced by the above-mentioned features, especially also of course by the declined shoulder portion, to which, in a preferred realization, some or all of the frangible elements are attached to.

BRIEF DESCRIPTION OF THE DRAWINGS

These and other features and advantages of the present invention will become even more apparent by the following figures, partly schematically showing preferred embodiments of the dispensing closure according to the present invention or elements thereof.

DETAILED DESCRIPTION OF THE PREFERRED EMBODIMENTS

Figure 1:
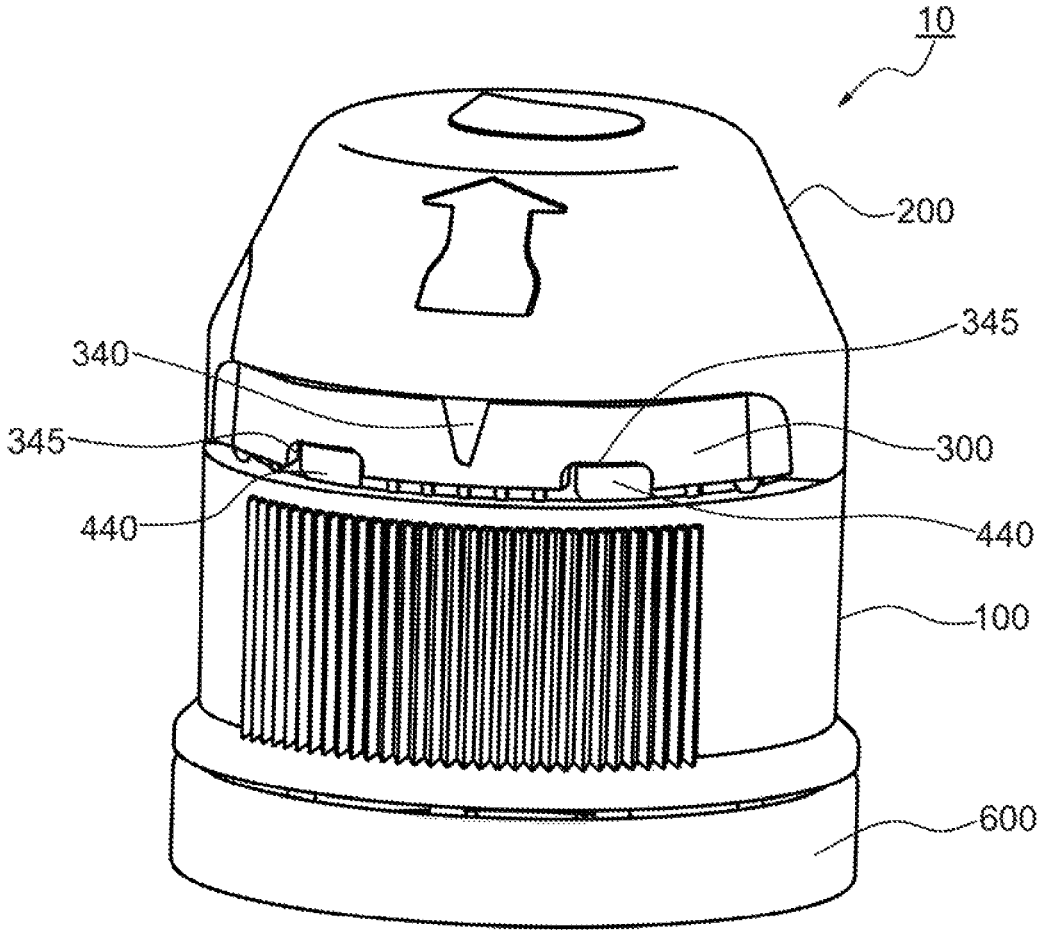
FIG. 1 shows an embodiment of a dispensing closure according to the present invention in a perspective view, with the dispensing closure being in its original, un-opened position.

FIG. 1 shows, in a schematic view, one embodiment of a dispensing closure 10 according to the present invention. The dispensing closure 10 comprises a base element 100, a flip-top lid 200 and a tamper-evident element 300.

Figure 2:
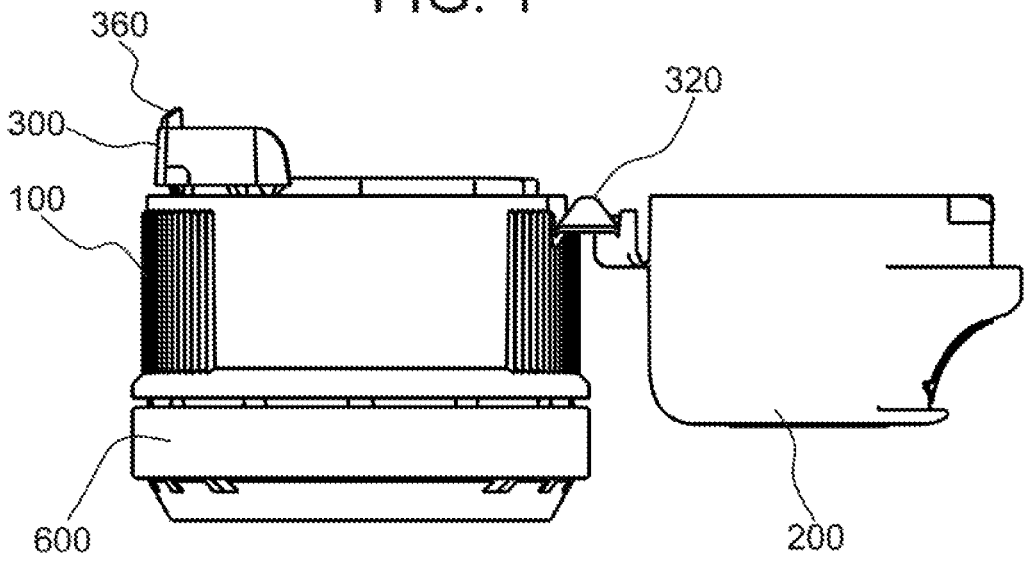
FIG. 2 shows the embodiment of a dispensing closure as in FIG. 1, in a position as it is manufactured e.g. by injection molding before a first closing of the flip-top lid, so that the tamper-evident element is still attached to the base element.

As can be seen in FIG. 2, the flip-top lid 200 is attached to the base 100 by a hinge 320, so that the flip-top lid 200 can be moved, by a user, between a closed position, see FIG. 1 and an opened position, see FIG. 2. However, it has to be noted that FIG. 2 shows the embodiment of the dispensing closure 10 in a condition before a first use, namely directly after manufacturing, with the flip-top lid still in the open position and the tamper-evident element 300 still being attached to the base element 100 via frangible elements (see especially FIG. 3), and before a first use, in other words in an intermediate manufacturing state, in order to better show the respective elements.

Figure 3:
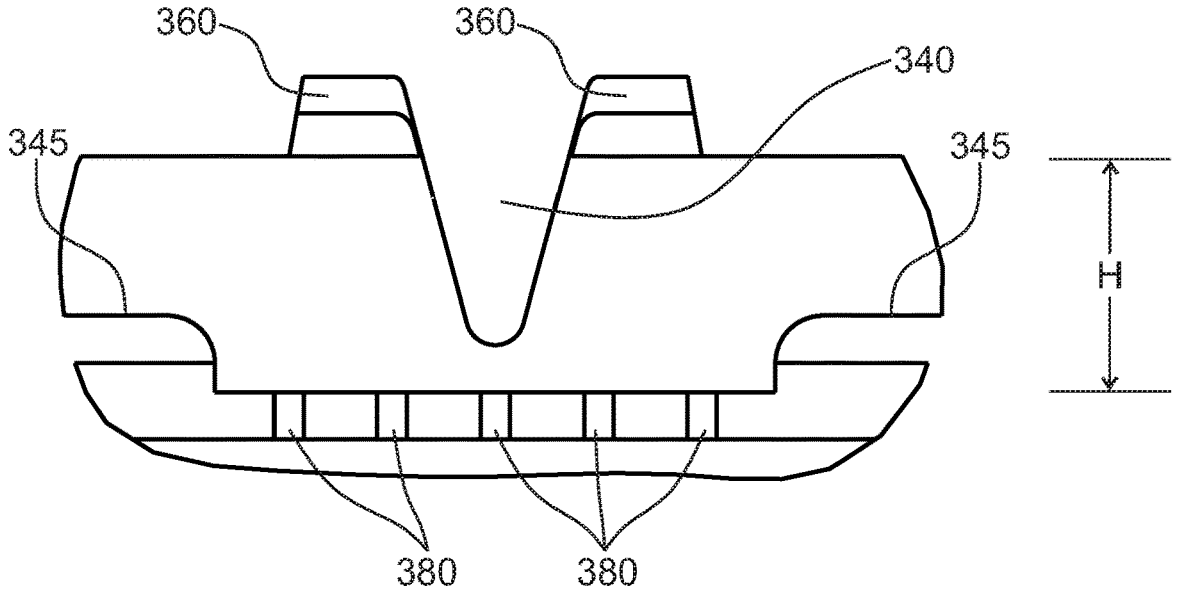
FIG. 3 shows a part of a tamper-evident element of the embodiment of a dispensing closure as shown in FIGS. 1 and 2.

The tamper-evident element 300 is, as can be especially well seen in FIG. 3, attached to the base 100 via a number of frangible elements 380.

The tamper-evident element 300 further has two opening 345 or windows, at its lower edge, in which two protrusions 440 of the flip-top lid 200 extend, when the flip-top lid 200 is in its closed position as shown in FIG. 3.

If therefore the flip-top lid 200 is moved from its closed position, FIG. 1, into its opened position, the protrusions 440, in engagement with the openings 345 or windows of the tamper-evident element 300, will also lift the tamper-evident element 300 in an upward direction, so that the tamper-evident element 300 will be detached from the base 100, thereby destroying the frangible elements 380.

Normally the tamper-evident element 300 will thereby be completely removed from the other parts of the closure, so that it is visible to all future users that the dispensing closure has been opened at least once.

Only for completion, it also has to be noted that the dispensing closure 10 comprises another tamper-evident device 600 which is a tamper-evident device 600 for showing whether the dispensing closure, which can be attached to a neck of a container (not shown), has been removed at least once from the container. Such tamper-evident devices 600 are well-known in the art, and there is no specific relationship to the tamper-evident element 300, which is a major part of the dispensing closure according to the present invention.

As can be well seen in FIG. 2 and especially in FIG. 3 the tamper-evident element 300 also comprises two locking extensions 360, which extend into the direction of the flip-top lid 300, when said flip-top lid 300 is in its closed position, whereby the two locking extensions 360 are enclosed by parts of the flip-top lid, so that the locking extensions 360 are enclosed or covered to the outside in order to avoid a tampering of these locking extensions by a user. With respect to a preferred realization of a flip-top lid being arranged such that the locking extensions 360 are enclosed or covered to the outside, see especially FIG. 9.

As can be further well seen in FIG. 3 the tamper-evident element 300 has a weakening region, which is realized in this embodiment as a notch 340. The notch 340 extends about a major part of the height H of the tamper-evident element 300, in this embodiment the notch 340 extends over about 80% of the height H of the tamper-evident element 300, while the notch starts at an upper end or an upper edge of the tamper-evident element 300, in other words at the side of the tamper-evident element 300 which is directed to the flip-top lid 200 when the flip-top lid 200 is in its closed position.

Furthermore the weakening region, here the notch 340, extends over the complete circumferential distance between the two locking extensions 360, at least at an upper part of the tamper-evident element 300, and the width of the notch 340 decreases in a downward direction, i.e. in a direction to the base element 100. The notch 340 therefore is formed essentially in a V- or U shape.

With respect to FIG. 3 it has to be mentioned that the protrusions (440, s. FIG. 1) of the flip-top lid 200 are not shown in order to enhance clarity of this figure, which especially shows the specific realization of the tamper-evident element 300, the two locking extensions 360, the notch 340 and some of the frangible elements 380, which attach or fasten the tamper-evident element 300 to the base 100.

Figure 4:
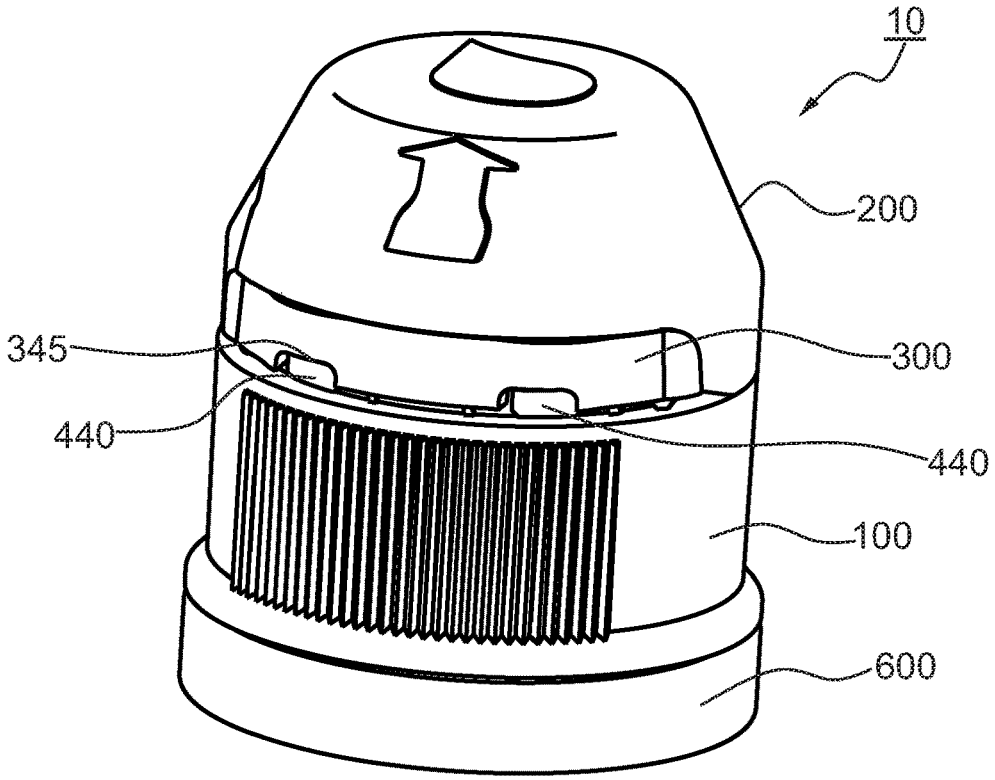
FIG. 4 shows a further embodiment of a dispensing closure according to the present invention in a perspective view, with the dispensing closure being in its original, un-opened position.

The notch 340 has the effect that, if a force is exerted onto the tamper-evident element 300, the tamper-evident element is more susceptible to deformation, especially in the area of this notch 340, FIG. 4 shows a perspective view of another embodiment of a dispensing closure according to the present invention. This embodiment is very similar to the first embodiment, similar or identical elements therefore bear the same reference numeral.

Also this embodiment of the dispensing closure 10 according to the present invention has a base element 100, a flip-top lid 200 and a tamper-evident element 300. With respect to the functioning it is especially referred to the description of the embodiment shown in FIGS. 1 to 3, especially with respect to the protrusions 440, interacting with openings 345 or windows of the tamper-evident element 300.

However, as can be well seen in FIG. 4, the tamper-evident element 300 of the dispensing closure 10 does not have a notch, but has weakening areas or weakening lines, which are provided at the inner side of the tamper-evident element 300, so that these weakening lines or areas cannot be seen in the perspective view of FIG. 4.

Figure 5:
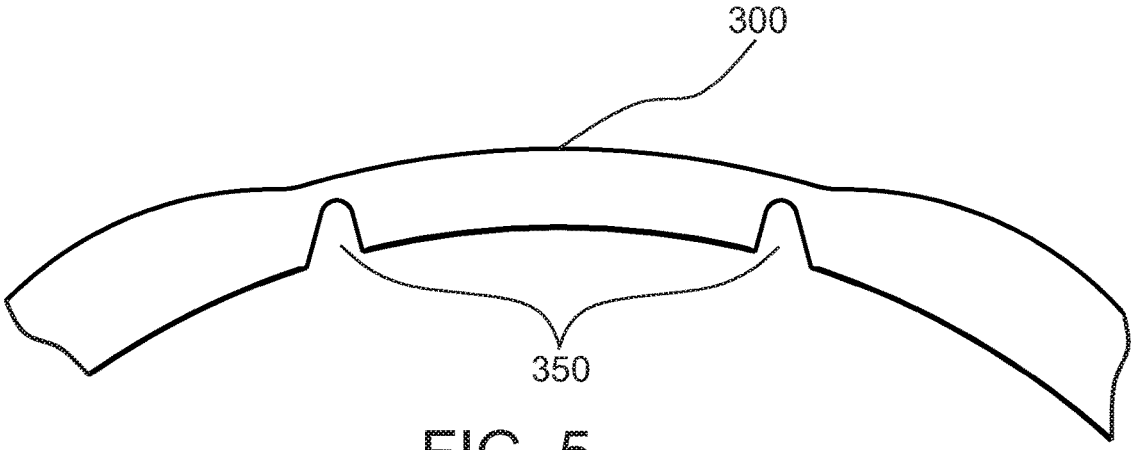
FIG. 5 shows a partial cross-section through a tamper-evident element of the embodiment of a dispensing closure as shown in FIG. 4.

FIG. 5 shows a partial cross-section through one embodiment of a tamper-evident element 300, which has, on its inner side, two weakening regions, being realized as weakening lines 350, extending over the complete height H of the tamper-evident element 300, therefore in a vertical direction.

The weakening lines 350 have the effect that, if a force is exerted onto the tamper-evident element 300, the tamper-evident element is more susceptible to deformation, especially in the area of these weakening lines 350.

Figure 6:
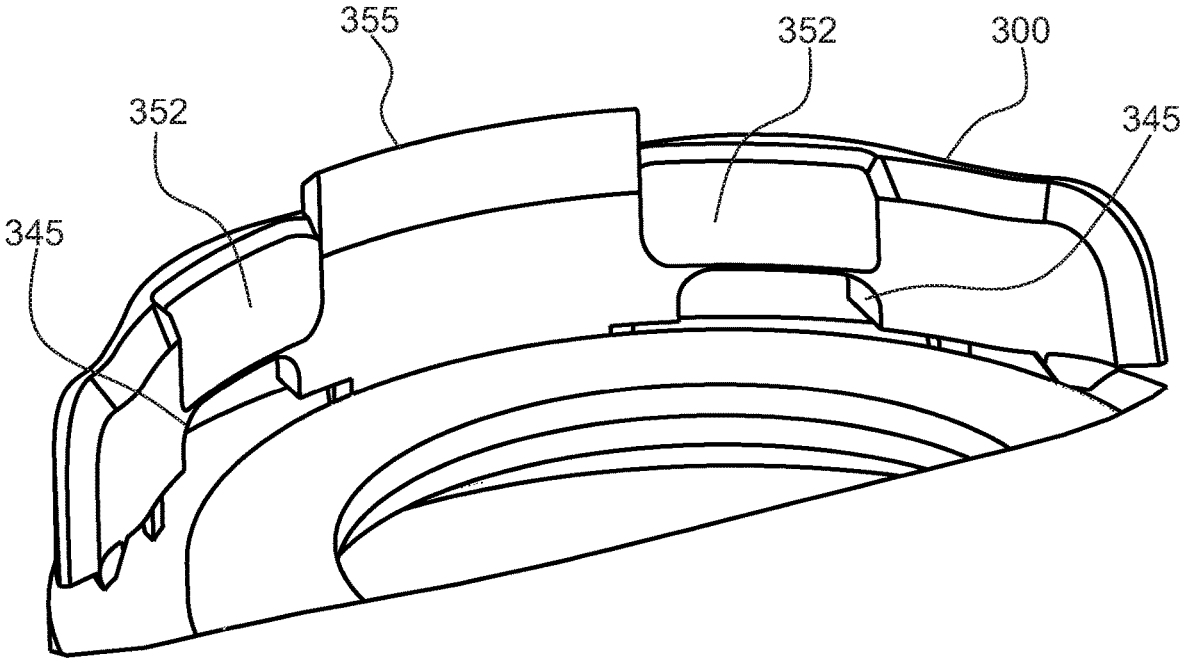
FIG. 6 shows a perspective view of parts of another embodiment of a dispensing closure according to the present invention, especially an embodiment of a tamper-evident element, which could be also e.g. used for an embodiment of the dispensing closure as shown in FIG. 4, the view showing especially the tamper-evident element from an inner side.

FIG. 6 shows another embodiment of a tamper-evident element of a dispensing closure according to the present invention, while FIG. 6 is a perspective view showing parts of the dispensing closure and the tamper-evident element 300 from the inside.

As can be well seen in FIG. 6, also this embodiment of the tamper-evident element 300 has two weakening regions, being realized as weakening areas 352, directly adjacent, in a circumferential direction, to one locking extension 355, which extends in a vertically upward direction, i.e. into the direction of a flip-top lid when the flip-top lid is in its closed position.

The weakening areas 352 extend about a certain angular distance in a circumferential direction over the tamper-evident element 300, in this embodiment by about 10. Generally, it is preferred that the weakening areas, here especially the weakening areas 352, extend about an angular distance in a circumferential direction being larger than the protrusions (440, see especially FIG. 1) of the flip-top lid (200, see also e.g. FIG. 1 or FIG. 4).

Beyond the purpose described above, these weakening areas also serve to enable a closing of the flip-top lid for the first time after manufacturing, so that the tamper-evident element 300 is not destroyed or damaged by the above-mentioned protrusions when closing the flip-top lid for the first time.

However, also these weakening areas 352 lead to the effect that the tamper-evident element 300 is especially susceptible to deformation at these weakening regions, so that such deformation can be easily seen by a user after the dispensing closure has been opened at least once, even if somebody would on purpose try to re-position the tamper-evident element after it has been torn off and after the frangible elements have been destroyed by a first opening of the flip-top lid.

Figure 7:
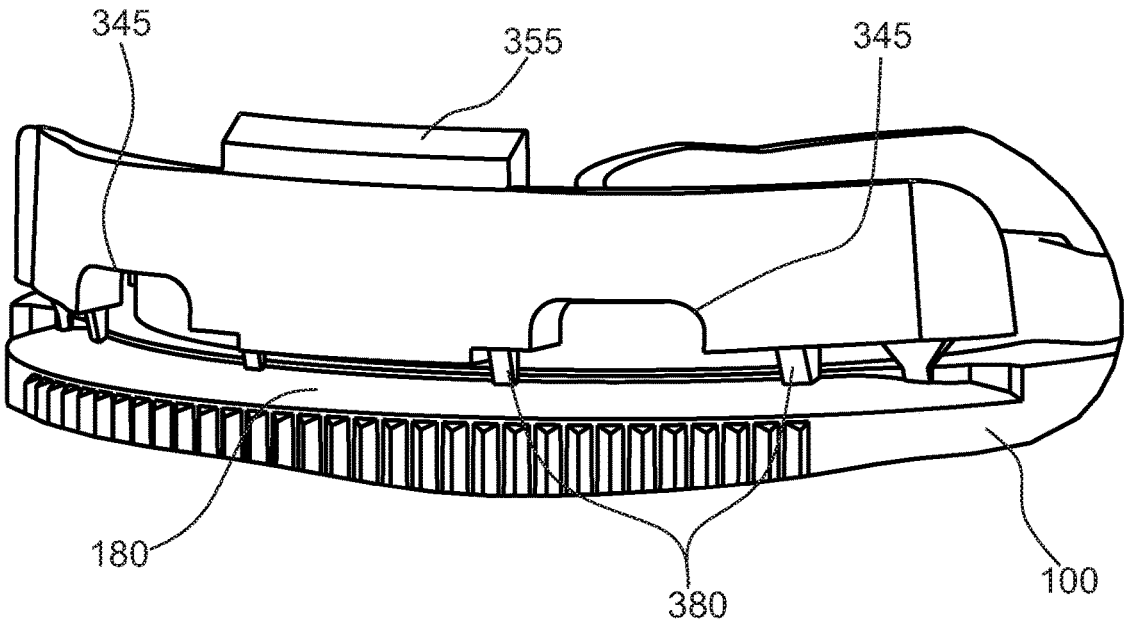
FIG. 7 shows a perspective view of the embodiment shown in FIG. 6, the view showing the tamper-evident element from the outside.

FIG. 7 shows some elements of an embodiment of the dispensing closure as shown in FIG. 6, however, from the outside, and as can be seen in FIG. 7, the weakening regions and weakening areas 352 are not visible from the outside.

However, FIG. 7 very well shows the frangible elements 380, which attach the tamper-evident element 300 to the base element 100, more exactly to a shoulder region 180 of the base element 100.

As can be also well seen in FIG. 7, the shoulder region 180 is inclined such that it declines in a radially outward direction of the base element 100. The declination angle in this embodiment is about 20° relative to a horizontal direction.

All frangible elements 380 are on the one side connected to the tamper-evident element 300 and on the other side to the declined shoulder region 180 of the base element 100.

This declined shoulder region 180 has the effect that even in case a detached tamper-evident element 300 should be re-positioned onto said shoulder region after the frangible elements 380 have been destroyed, the tamper-evident element tends to automatically shift its position and slid away on the declined shoulder portion 180 simply by gravitational forces.

Figure 8:
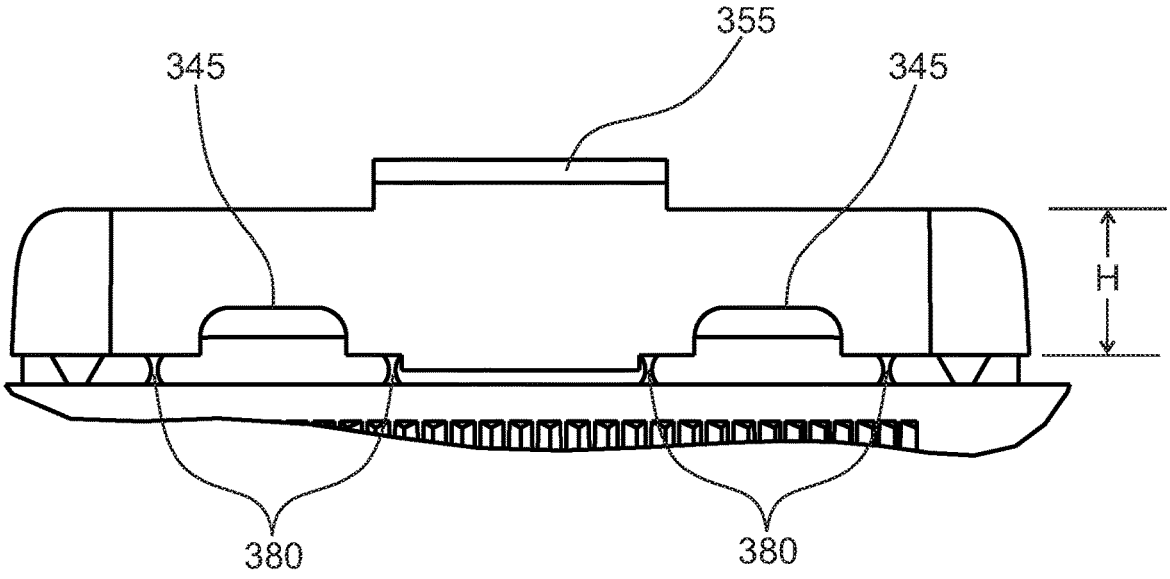
FIG. 8 shows parts of another embodiment of a dispensing closure according to the present invention, especially another embodiment of a tamper-evident element.

FIG. 8 shows some elements of a still further embodiment of a dispensing closure according to the present invention, especially a tamper-evident element 300 and parts of the base 100.

The tamper-evident element 300 of this embodiment is very similar to the tamper-evident element shown in FIGS. 6 and 7, however, the frangible elements 380 are different.

As can be well seen in FIG. 8, most of the frangible elements 380 have an hour-glass shape, in spite of the typically cubical form of the frangible elements used in such dispensing closures. The hour-glass shape of the frangible elements 380 leads to the effect that after destruction the remaining parts of the frangible elements 380 are more elongated than typically shaped frangible elements, and this will make it even more difficult to keep the tamper-evident element in its original position after the frangible elements 380 have been destroyed, even if a user should try to re-position the tamper-evident element on purpose after a destruction of the frangible elements 380.

In another preferred embodiment, all frangible elements 380 are realized in an hour-glass shape.

Figure 9:
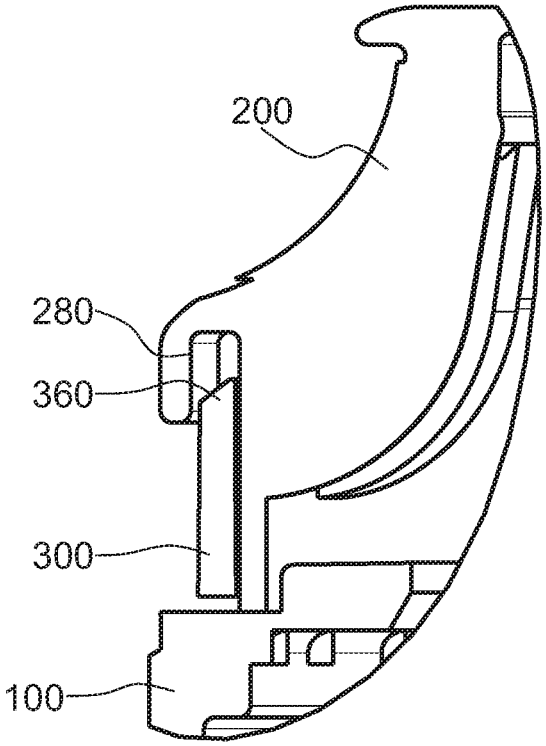
FIG. 9 shows a partial cross-section of an embodiment of a dispensing closure according to the present invention with the dispensing closure being in its original, un-opened position.

FIG. 9 shows a partial cross-section through another embodiment of a dispensing closure according to the present invention, which is very similar to the embodiment shown in FIGS. 1 to 3. As can be well seen in FIG. 9, the tamper-evident element 300 has locking extensions 360 (one of which is shown and visible in the cross-section of FIG. 9), while the locking extensions protrude into a recess 280 such that the locking extensions 360 are enclosed and covered to the outside so that a tampering of these locking extensions by a user is avoided. The features of the present invention disclosed in the specification, the claims and/or in the accompanying drawings may, both separately and in any combination thereof, be material for realizing the invention in various forms thereof,

The invention claimed is:

1. Dispensing closure comprising a base element (100) which can be attached to a neck of a container and which comprises a dispensing opening, a flip-top lid (200), being attached to said base element (100) by a hinge (320) and being movable between a closed position, in which the dispensing opening is closed by a closing element of said flip-top lid, and an opened position, in which said dispensing opening is at least partly opened such that a fluid can be dispensed through said dispensing opening, a tamper-evident element (300) extending in a circumferential direction around at least a part of the circumference of said dispensing closure and being attached to a shoulder region (180) of said base element by at least two frangible elements (380) having a pre-determined breaking point, said flip-top lid (200) having at least one opening or recession being arranged and dimensioned such that it encloses at least part of at least one locking extension (355) of the tamper-evident element (300) extending at least partly into the direction of the flip-top lid (200), when said flip-top lid (200) is in its closed position and said tamper-evident element (300) is in its original position with the frangible elements (380) being undestroyed, characterized in that said tamper-evident element (300) has at least one weakening region (340, 350, 352), said at least one weakening region (340, 350, 352) extending at least over a part of a height (H) of the tamper-evident element (300), and/or said shoulder region (180) of said base element (100), to which said frangible elements (380) of said tamper-evident element (300) are attached, is inclined such that it declines in an outward direction of the base element (100).

2. Dispensing closure according to claim 1, wherein said at least one weakening region comprises a notch (340) extending over a part of the height (H) of the tamper-evident element (300).

3. Dispensing closure according to claim 1, wherein said at least one weakening region (350, 352) comprises a weakening area (352) or line (350), reducing the thickness of the tamper-evident element (300) over at least part of the height of the tamper-evident element (300).

4. Dispensing closure according to claim 3, wherein said weakening area (352) or line (350) is provided on the inner side of the tamper-evident element (300).

5. Dispensing closure according to claim 1, wherein said tamper-evident element (300) comprises two locking extensions (360) and wherein said weakening region (340) is provided, in a circumferential direction, between these two locking extensions (360).

6. Dispensing closure according to claim 5, wherein said weakening region (340) extends over the complete circumferential distance between the two locking extensions (360).

7. Dispensing closure according to claim 1, wherein said tamper-evident element (300) comprises only one locking extension (355) and at least two weakening regions (352) which, in a circumferential direction of the tamper-evident element (300), are positioned directly adjacent said one locking extension (355).

8. Dispensing closure according to claim 1, having said frangible elements (380) in a circumferential position of said tamper-evident element (300) in the vicinity of said weakening region (350).

9. Dispensing closure according to claim 1, having said frangible elements (380) positioned, in a circumferential direction, at the circumferential borders of said at least one locking extension (355) or in the direct vicinity thereof.

10. Dispensing closure according to claim 1, wherein the at least one weakening region comprises multiple weakening regions (350) over the extension of the tamper-evident element (300) in its circumferential direction.

11. Dispensing closure according to claim 1, wherein the number of frangible elements (380) per angular extension of the tamper-evident element (300) in its circumferential direction is higher in those circumferential angular regions where said locking extension is provided compared to those angular circumferential regions where no locking extension of the tamper-evident element (300) is provided.

12. Dispensing closure according to claim 1, wherein said shoulder region (180) of said base element (100) is declined in a radially outward direction by an angle of 10° to 45° relative to a horizontal direction.

13. Dispensing closure according to claim 12, wherein said shoulder region (180) is declined over at least the complete circumferential extension of the tamper-evident element (300).

14. Dispensing closure according to claim 1, wherein all frangible elements (380) are attached to said shoulder region (180) of said base element (300) in an area where said shoulder region is declined.

15. Dispensing closure according to claim 1 wherein each of said at least one of the two frangible elements (380) has an hour-glass shape.

* * * * *